US006047763A

United States Patent [19]

Murakami et al.

[11] Patent Number: 6,047,763

[45] Date of Patent: Apr. 11, 2000

[54] METAL RIBBON MANUFACTURING APPARATUS

[75] Inventors: Junichi Murakami; Takashi Hatanai; Akihiro Makino, all of Niigata-ken, Japan

[73] Assignee: Alps Electric Co., Ltd., Tokyo, Japan

[21] Appl. No.: 09/144,387

[22] Filed: Aug. 31, 1998

[30] Foreign Application Priority Data

Sep. 2, 1997 [JP] Japan ..... 9-237473
Jun. 3, 1998 [JP] Japan ..... 10-155036

[51] Int. Cl.[7] ..... B22D 11/00; B22D 11/06

[52] U.S. Cl. ..... 164/423; 164/463; 164/415

[58] Field of Search ..... 164/423, 463, 164/415

[56] References Cited

FOREIGN PATENT DOCUMENTS 0145933 6/1985 European Pat. Off. .
0183220 6/1986 European Pat. Off. .
56-17167 2/1981 Japan .
62-110847 10/1987 Japan .
4-356336 5/1993 Japan .
8309493 11/1996 Japan .

*Primary Examiner*—Kuang Y. Lin
*Attorney, Agent, or Firm*—Brinks Hofer Gilson & Lione

[57] ABSTRACT

A metal ribbon manufacturing apparatus which comprises a cooling roll having a cooling surface for cooling a melt, a melt nozzle confronting the cooling surface with a prescribed gap maintained between it and the cooling roll, gas flow supply means for supplying an inert gas to the periphery of the melt nozzle, roll outside periphery atmosphere shutoff means for covering at least a portion of the outside periphery of the cooling roll and preventing the atmosphere from being rolled in by the rotation of the cooling roll, and an atmosphere staying portion disposed on the front side in the rotating direction of the cooling roll of the roll outside periphery atmosphere shutoff means.

18 Claims, 17 Drawing Sheets

METAL RIBBON MANUFACTURING APPARATUS

BACKGROUND OF THE INVENTION

1. Field of the invention

The present invention relates to an apparatus for and a method of manufacturing a metal ribbon of an amorphous metal and the like.

2. Description of the Related Art

A single roll method which uses a single cooling roll has come into widest use as a method of manufacturing a metal ribbon. FIG. 24 shows the main portion of an apparatus for embodying the single roll method, wherein a cooling roll 101 is rotated at a high speed and a melt 103 is jetted from a melt nozzle 102, which is located in the vicinity of the apex of the cooling surface of the cooling roll 101, so that the melt 103 is rapidly solidified on the cooling surface of the cooling roll 101 and drawn out in the rotating direction of the cooling roll (toward the direction of an arrow A).

The melt 103 jetted from the melt nozzle 102 forms a staying portion (hereinafter, referred to as a "puddle") 104 between the extreme end of the melt nozzle 102 and the cooling surface of the cooling roll 101. As the cooling roll 101 rotates, the melt 103 is successively drawn out from the puddle 4, rapidly cooled and solidified on the surface of the cooling roll 101 and a ribbon 105 is continuously formed.

When a material used in the single roll method is composed of a component which is liable to be oxidized, the melt nozzle 102 is clogged with the material by the oxidation thereof and the jet of a melt may be prevented by it. To solve the problem, there is conventionally proposed a method of preventing the oxidation of the material by disposing an overall ribbon manufacturing apparatus in a chamber and filling the interior of the chamber with an inert gas to thereby reduce an oxygen concentration in the vicinity of the melt nozzle.

The method of filling the interior of the chamber with the inert gas is very effective to prevent the clogging of the melt nozzle. However, it is defective in workability because the overall apparatus is disposed in the chamber. For example, there is required a troublesome job of opening the chamber each one charge and charging a material to be melted to a melting furnace or a crucible, closing the chamber again and thereafter replacing the atmosphere in the chamber with the inert gas atmosphere. there is also a problem that a large cost is necessary to attendant equipment for maintaining the interior of the chamber to the inert gas atmosphere.

SUMMARY OF THE INVENTION

To cope with the above problem, a subject of the present invention is to provide a metal ribbon manufacturing apparatus capable of reducing the oxygen concentration of an atmosphere in the vicinity of a melt nozzle without the provision of attendant equipment such as a chamber which is large in size and inferior in workability.

When a quantity of oxygen can be reduced by making only the vicinity of a melt nozzle to an inert gas atmosphere to prevent the clogging of the melt nozzle, an overall metal ribbon manufacturing apparatus need not be disposed in an inert gas atmosphere, contrary to a conventional practice. Then, when there is employed equipment which makes only the vicinity of a melt nozzle to the inert gas atmosphere, workability can be more enhanced and an equipment cost can be more reduced as compared with the conventional chamber.

As a result of an examination executed by the inventors in view of the above point, the inventors have found that the provision of atmosphere shutoff means at proper positions for the prevention of the roll-in of the atmosphere to the periphery of the melt nozzle, which is caused by the rotation of a cooling roll, can effectively reduce a quantity of oxygen in the vicinity of the melt nozzle.

The present invention, which has been made based on the above knowledge, relates to a metal ribbon manufacturing apparatus which comprises a cooling roll having a cooling surface for cooling a melt; a melt nozzle confronting the cooling surface with a prescribed gap maintained between it and the cooling roll; gas flow supply means for supplying an inert gas to the periphery of the melt nozzle; roll outside periphery atmosphere shutoff means for covering at least a portion of the outside periphery of the cooling roll and preventing the atmosphere from being rolled in by the rotation of the cooling roll; and an atmosphere staying portion disposed on the front side in the rotating direction of the cooling roll of the roll outside periphery atmosphere shutoff means.

The atmosphere staying portion of the present invention may be disposed internally or externally of the roll outside periphery atmosphere shutoff means. When the atmosphere staying portion has an open area which is larger than that of the roll outside periphery atmosphere shutoff means, an atmosphere staying effect can be enhanced. Further, the atmosphere staying effect can be also enhanced by separating the atmosphere staying portion by a plurality of partitions.

The atmosphere staying portion of the present invention can be arranged such that the open area thereof changes toward the rotating direction of the cooling roll. More specifically, there is a case that the open area of the atmosphere staying portion increases in the rotating direction of the cooling roll and a case that it decreases on the contrary. In addition, the sides of the atmosphere staying portion may be formed to a curved surfaces.

In the present invention, it is more preferable that the roll outside periphery atmosphere shutoff means comprises shutoff plates which are disposed to the front side in the rotating direction of the cooling roll, to the sides of the cooling roll and to the back in the rotating direction of the cooling roll.

Further, it is preferable that a passing port through which a metal ribbon, which is formed by being cooled by the cooling roll, passes is formed to the shutoff plate disposed on the front side in the rotating direction of the cooling roll.

It is preferable to dispose the gas flow supply means at two positions on the back side in the rotating direction of the cooling roll and at one position in the rotating direction thereof with respect to the melt nozzle. In particular, it is more preferable that one of the two gas flow supply means, which are disposed on the back side in the rotating direction of the cooling roll, is disposed such that the slit thereof confronts the extreme end of the melt nozzle, the other of the two gas flow supply means is interposed between the melt nozzle and the above one gas flow supply means and the gas flow from the other gas flow supply means is supplied onto the gas flow from the above one gas flow supply means.

When a ribbon is manufactured by means of the metal ribbon manufacturing apparatus of the present invention, it is preferable to supply an inert gas before the cooling roll rotates. This is because that an oxygen concentration can be more rapidly reduced by supplying the inert gas before the cooling roll rotates than after it rotates. Therefore, it is preferable to production efficiency to measure the oxygen concentration of an atmosphere in the vicinity of the melt nozzle and rotate the cooling roll after the oxygen concentration reaches a prescribed value.

In the present invention, the inert gas is supplied under the conditions of a flow speed set to 2–80 m/sec and a flow rate set to 200–900 l/min. This is because that when the flow speed is less than 2 m/sec, it is not effective to the reduction of the quantity of oxygen in the atmosphere in the vicinity of the melt nozzle, whereas when the flow speed exceeds 80 m/sec, the atmosphere is rolled in from the periphery of the melt nozzle by a gas flow so that an oxygen concentration reducing effect is lowered. Further, when the flow rate is less than 200 l/min, it is also not effective to the reduction of the quantity of oxygen in the atmosphere in the vicinity of the melt nozzle, whereas even if the flow rate exceeds 900 l/min, an effect corresponding to a quantity supplied cannot be expected. A more preferable range of the gas flow is 700–900 l/min and the most preferable value thereof is 830 l/min.

The inert gas may be supplied from any one of the back side and the front side of the melt nozzle or from both the back and front sides. It is preferable that the inert gas is supplied by gas flows through two systems from the back side and a gas flow passing through one system from the front side. In this case, when one of the gas flows passing through the two systems from the back side is supplied from a tangential direction of the cooling roll and the other of them is supplied from above the aforesaid one gas flow, the oxygen concentration can be greatly reduced.

In this case, it is preferable that the one of the gas flows passing through the two systems from the back side (first gas flow) has a flow speed of 10–35 m/sec and a flow rate of 5–400 l/min, the other of the gas flows (second gas flow) has a flow speed of 2–10 m/sec and a flow rate of 5–400 l/min, the gas flow supplied from the front side (third gas flow) has a flow speed of 10–50 m/sec and a flow rate of 5–400 l/min. More preferable ranges of the first, second and third gas flows are as follows: the flow speed and flow rate of the first gas flow are 15–25 m/sec and 5–300 l/min, respectively; the flow speed and flow rate of the second gas flow are 3–7 m/sec and 5–300 l/min, respectively; and the flow speed and flow rate of the third gas; flow are 30–45 m/sec and 5–300 l/min, respectively.

Further, the most preferable flow rates of the first, second and third gas flows are 300 l/min, 280 l/min and 250 l/min, respectively.

Although the above gas flows are relatively locally supplied to positions near to the melt nozzle, it is also effective to supply gas flows over a wide range including at least the cooling roll from above and below the cooling roll and/or from the side directions thereof to :supplement the above gas flows.

Although the inert gas used to the metal ribbon manufacturing apparatus of the present invention is one kind or two or more kinds selected from $N_2$, He, Ar, Kr, Xe and Rn, Ar is most preferable as apparent from an embodiment to be described below.

DESCRIPTION OF THE PREFERRED EMBODIMENT

An embodiment of a metal ribbon manufacturing apparatus of the present invention will be described below based on FIG. 1 to FIG. 20.

Figure 1:
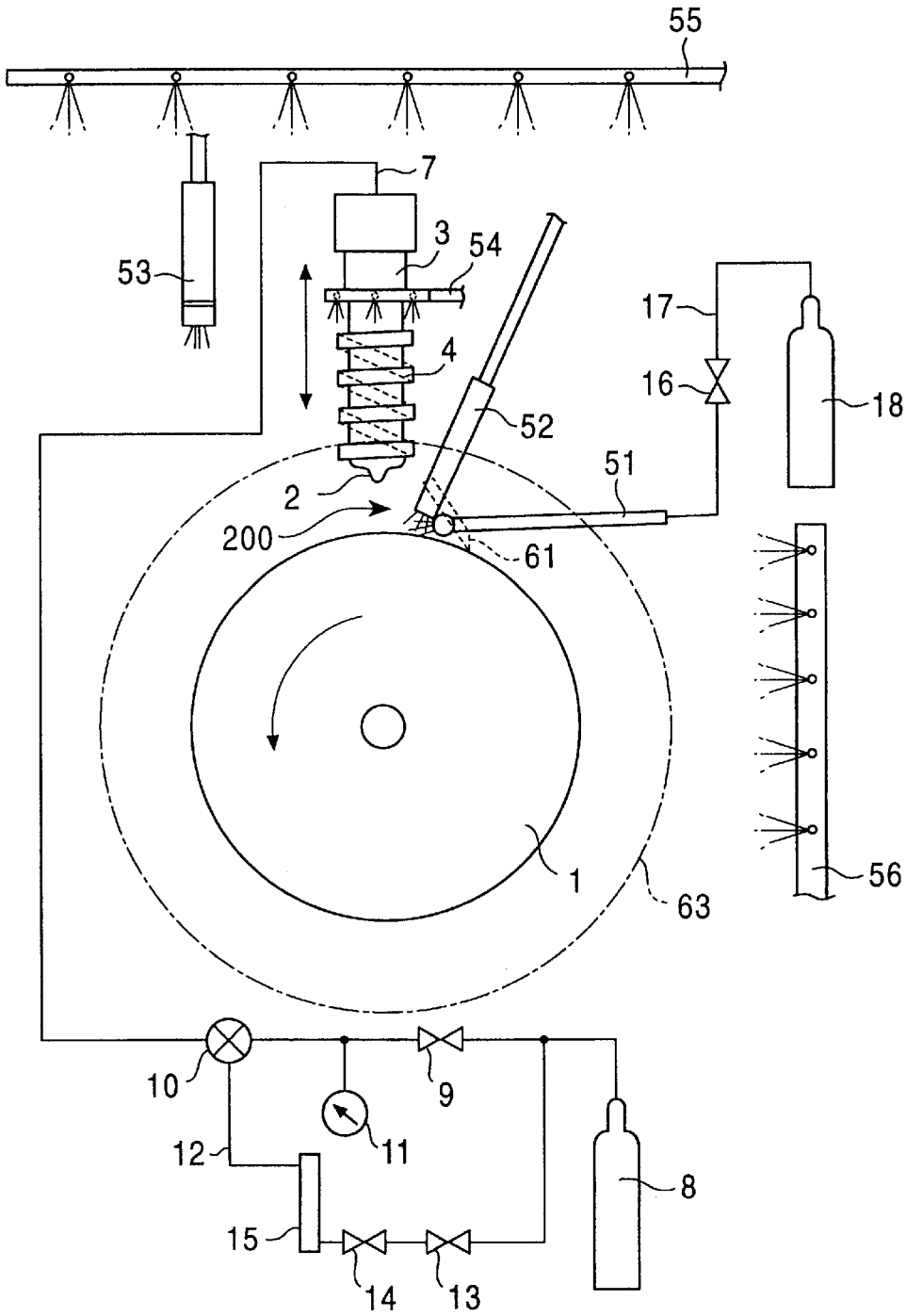
FIG. 1 is a side elevational view showing an embodiment of a metal ribbon manufacturing apparatus of the present invention.
Figure 17A:
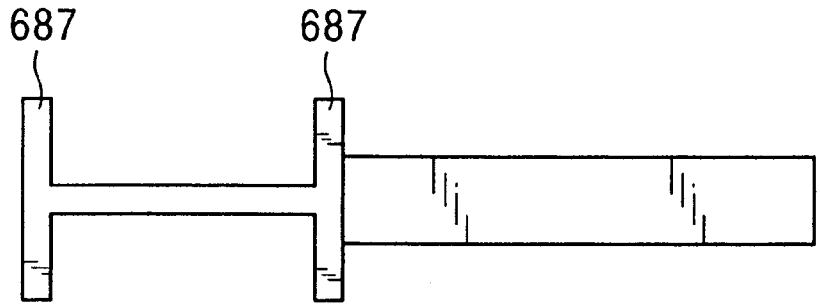
FIG. 17 is a view showing still another form of the outside peripheral shape of the atmosphere staying portion.
Figure 17B:
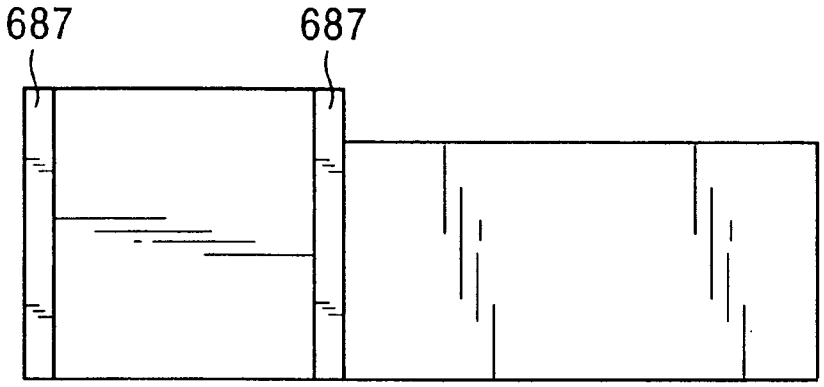
Figure 18:
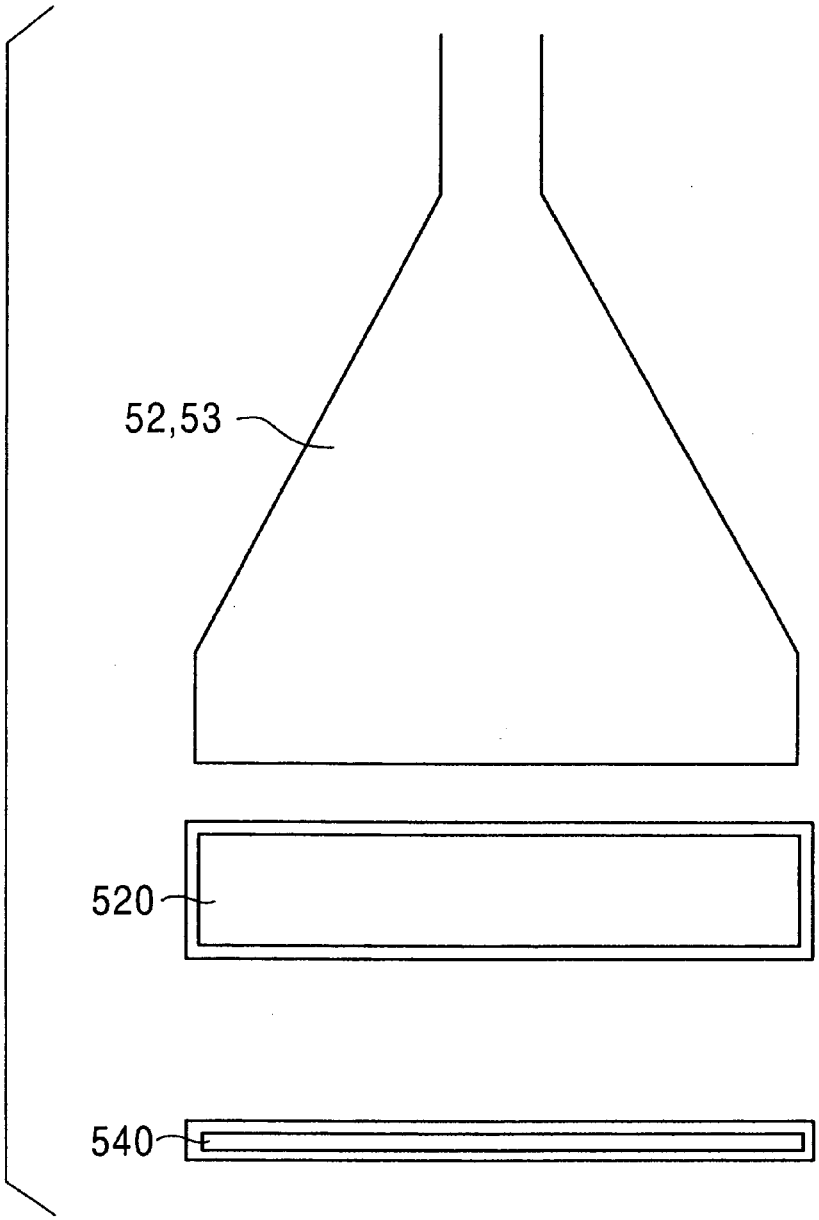
FIG. 18 is a view showing second and third gas flow nozzles.
Figure 19:
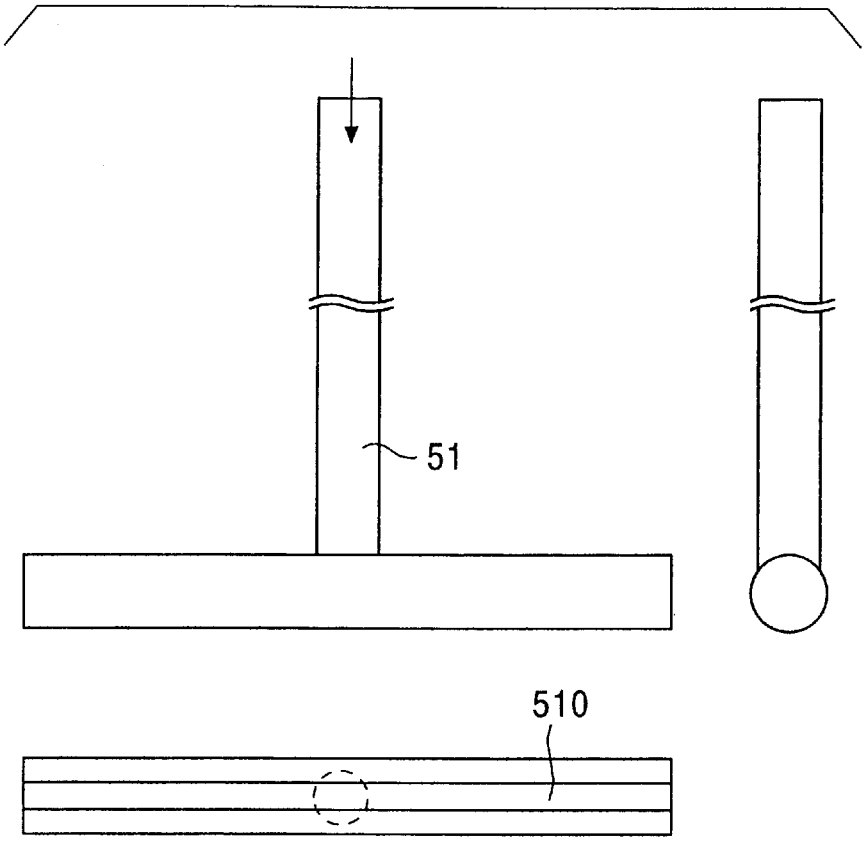
FIG. 19 is a view showing a first gas flow nozzle.
Figure 20:
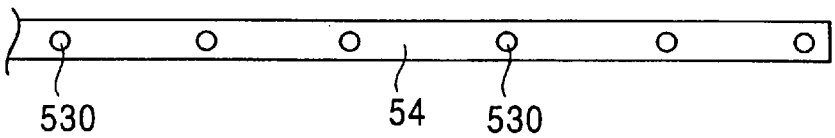
FIG. 20 is a view showing a fourth gas flow nozzle.

FIG. 1 is a side elevational view showing the basic components (excluding some atmosphere shutoff plates) of the metal ribbon manufacturing apparatus according to the embodiment, FIG. 2 to FIG. 10 are views explaining respective atmosphere shutoff plates and an atmosphere staying portion, FIG. 11 to FIG. 17 are views showing various forms of the atmosphere staying portion and FIG. 18 to FIG. 20 are views showing the detail of a gas flow nozzle as gas flow supply means.

The metal ribbon manufacturing apparatus according to the embodiment basically comprises a cooling roll 1, a melt nozzle 2 connected to the lower end of a crucible 3 for holding a melt, a heating coil 4 wound and disposed around the outside periphery of a crucible 3, first to fourth gas flow nozzles 51 to 54 for flowing an inert gas, atmosphere shutoff plates 61 to 67 for shutting of the flow of the atmosphere to the vicinity of the melt nozzle and an atmosphere staying portion 68.

The cooling roll 1 is driven in rotation in the direction of an arrow (counterclockwise) by a not shown motor. It is preferable to compose at least the surface of the cooling roll 1 of Fe-based alloy such as carbon steel, for example, JIS S45C (Japan Industrial Standard) or the like, brass (Cu—Zn alloy) or pure copper. When at least the surface of the cooling roll 1 is composed of the brass or the pure copper, the cooling roll 1 has a high cooling effect and is suitable to rapidly cool the melt because the brass or the pure copper has high thermal conduction. It is preferable to dispose a cooling structure to the interior of the cooling roll 1 to enhance the cooling effect.

The melt which was melt in the crucible 3 is jetted from the melt nozzle 2 located at the lower end of the crucible 3.

The upper portion of the crucible 3 is connected to a gas supply source 8 for supplying a gas such as an Ar gas or the like through a supply pipe 7 as well as a pressure regulating valve 9 and an electromagnetic valve 10 are assembled to the supply pipe 7 and a pressure gage 11 is assembled between the pressure regulating valve 9 and the electromagnetic valve 10 in the supply pipe 7. Further, an auxiliary pipe 12 is connected to the supply pipe 7 in parallel therewith and a pressure regulating valve 13, a flow regulating valve 14 and a flow meter 15 are assembled to the auxiliary pipe 12. Therefore, the melt can be jetted onto the cooling roll 1 from the melt nozzle 2 by supplying the gas such as the Ar gas or the like from the gas supply source 8 into the crucible 3.

When a metal ribbon is manufactured, the melt is jetted from the nozzle 2 disposed in the vicinity of the apex of the cooling roll 1 or slightly forward of the apex while rotating the cooling roll 1 at a high speed to thereby rapidly cool and solidify the melt on the surface of the cooling roll 1 and the resultant ribbon is (draw out in the rotating direction of the cooling roll 1 in a strip state. The melt blowout port of the melt nozzle 2 has a rectangular shape and it is preferable that the blowout width of the port (width in the rotating direction of the cooling roll 1) is about 0.2–0.8 mm. This is because that when the blowout width is less than 0.2 mm, the melt nozzle is liable to be clogged with the melt depending upon a composition of the melt, whereas when it exceeds 0.8 mm, it may be difficult to sufficiently cool the melt.

When the metal ribbon is manufactured, the interval between the cooling roll 1 and the melt nozzle 2 may be selected from a range of 0.2 to 0.8 mm. This is because that when the interval is less than 0.2 mm, it is difficult to jet the melt and there is a possibility that the melt nozzle 2 is broken, whereas when it exceeds 0.8 mm, it is difficult to manufacture a ribbon having a good property. the crucible 3 can be lifted and lowered by not shown lifting/lowering means so that the interval between the cooling roll 1 and the melt nozzle 2 can be adjusted. Since the diameter of the cooling roll 1 is increased by the thermal expansion of the surface thereof which is caused by a temperature increase after the manufacture of the metal ribbon starts, it is preferable to gradually increase the interval between the cooling roll 1 and the melt nozzle 2 to manufacture a ribbon having a thickness of pinpoint accuracy.

The first gas flow nozzle 51 is disposed backward with respect to the melt nozzle 2. The first gas flow nozzle 51 flows the gas to the vicinity 200 at the extreme end of the melt nozzle 2 (hereinafter, referred to as a puddle portion 200) from the tangential direction of the cooling roll 1 backward of it. As shown in FIG. 19, the first gas flow nozzle 51 has a relatively narrow slit 510 with a width of 5 mm and flows the gas at a relatively fast flow speed.

The second gas flow nozzle 52 is interposed between the melt nozzle 2 and the first gas flow nozzle 51 to supply a gas flow for preventing the atmosphere from being rolled in the gas flow supplied from the first gas flow nozzle 51 by shutting off the gas flow from the atmosphere. As shown in FIG. 18, the second gas flow nozzle 52 has a slit 520 of 20 mm wide which is wider than that of the first gas flow nozzle 51 and supplies the gas flow at a flow speed which is slower than that of the first gas flow.

An object of the third gas flow nozzle 53 is to prevent the flow of the atmosphere from the front direction forward of the cooling roll 1. The third gas flow nozzle has the same shape as that of the second gas flow nozzle 52 except that the slit 540 thereof has; a narrower width of 2.5 mm. The length of the slits 510, 520 and 540 of the first to third gas nozzles 51–53 are set to 100 mm.

As shown in FIG. 20, the fourth gas flow nozzle 54 is composed of a copper pipe having a 5 mm diameter which is provided with 10 gas flow slits 530 which have a diameter of 2 mm and are disposed to one side thereof at intervals of 20 mm. The fourth gas flow nozzle 54 is wound around the crucible 3 in an arc shape and disposed at an upper portion thereof. An object of the fourth gas flow nozzle 54 is to prevent the atmosphere from being rolled in the puddle portion 200 by supplying the gas from above the melt nozzle 2 downward so that the gas surrounds the melt nozzle 2.

The first to fourth gas flow nozzles can be individually used as well as a plurality of them may be used in combination and they may be suitably selected depending upon a degree of easiness of oxidation of the melt. The first and second gas flow nozzles have the largest effect for reducing the oxygen in the puddle portion 200.

Although a main object of the first to fourth gas flow nozzles is to make local gas flows, there may be provided gas flow supply means such as a fifth gas flow nozzle 55 and a sixth gas flow nozzle 56 for supplying gas flows to a wide range including the diameter of the cooling roll 1 as shown in FIG. 1. The oxygen concentration reducing effect achieved by the first to fourth gas flow nozzle can be more enhanced by supplying the gas flows by the fifth gas flow nozzle 55 and the sixth gas flow nozzle 56. It is preferable that the fifth gas flow nozzle 55 and the sixth gas flow nozzle 56 supply the gas flows in the quantities of 25–500 l/min and 20– 500 l/min, respectively.

The above respective gas flow nozzles are connected to a gas supply source 18 through a connecting pipe 17 to which a pressure regulating valve 16 is connected as exemplified in FIG. 1 as to the first gas flow nozzle 51.

Next, the atmosphere shutoff plates will be described.

The roll surface atmosphere shutoff plate 61 is disposed to shut off the flow of the atmosphere deposited on the surface of the cooling roll 1 to the puddle portion 200. It has a plate-shaped structure having an acute-angle extreme end and is disposed so that the acute-angle extreme end comes into contact with the surface of the cooling roll 1 (see FIG. 5). Therefore, when the cooling roll 1 rotates at a high speed, the atmosphere, which is deposited on the surface of the cooling roll 1 and tends to flow to the puddle portion 200, is shut off in such a manner that it is scraped off by the roll surface atmosphere shutoff plate 61. As shown in FIG. 1, since the first and second gas flow nozzles 51, 52 are interposed between the roll surface atmosphere shutoff plate 61 and the melt nozzle 2 as shown in FIG. 1, the inert gas flows are supplied just after the atmosphere is shut off by the roll surface atmosphere shutoff plate 61 to thereby enhance the oxygen concentration reducing effect of the puddle portion 200. A plurality of the roll surface atmosphere shutoff plates 61 may be provided to more effectively shut off the flow of the atmosphere to the puddle portion 200.

Figure 6:
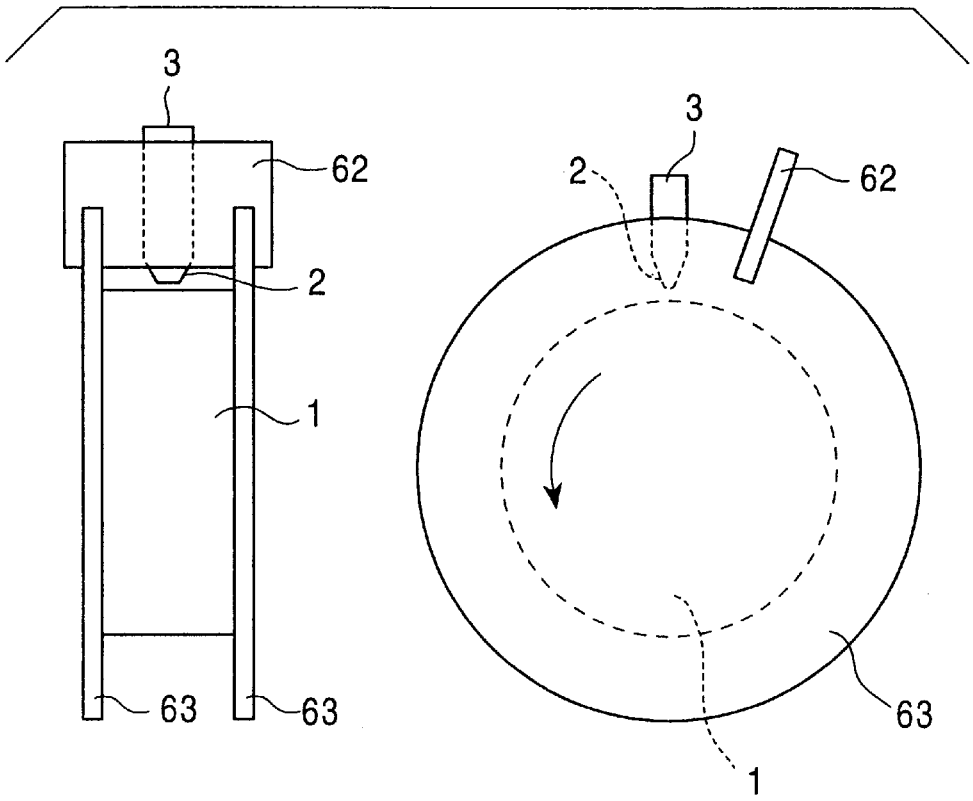
FIG. 6 is a view showing the disposition of a roll backward atmosphere shutoff plate.

The roll backward atmosphere shutoff plate 62 is disposed to shut off the flow of the atmosphere from the lower back portion of the cooling roll 1 and has a flat-plate-shaped structure having a width larger than the width of the cooling roll 1 (see FIG. 6).

The roll surface atmosphere shutoff plate 61 and the roll backward atmosphere shutoff plate 62 are disposed by being spaced apart from the melt nozzle 2 toward the back of the rotational direction of the cooling roll 1, that is, in a direction opposite to a direction in which the metal ribbon is drawn out.

The roll side atmosphere shutoff plates 63, each formed to a disc-shape having a diameter larger than that of the cooling roll 1, are disposed in contact with both the sides of the cooling roll 1 to shut off the roll-in of the atmosphere from the sides of the cooling roll 1 (see FIG. 1–FIG. 4).

Figure 2:
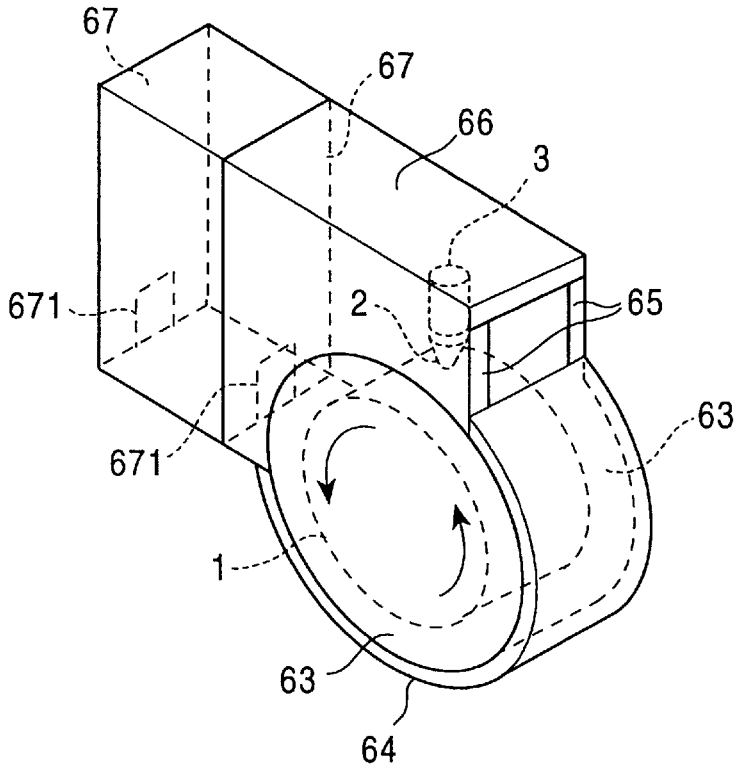
FIG. 2 is a view showing an example of the disposition of atmosphere shutoff plates.
Figure 3:
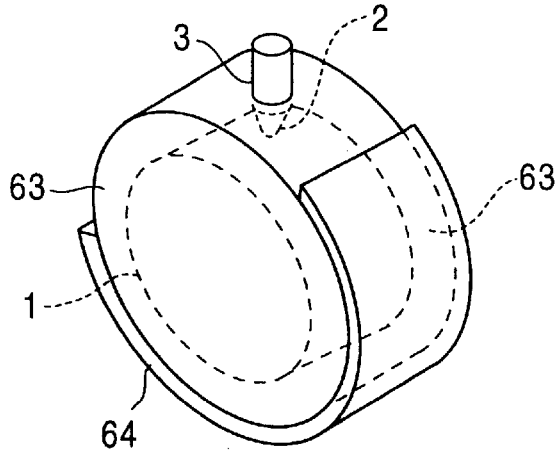
FIG. 3 is a view showing a roll outside periphery atmosphere-shutoff plate.
Figure 4:
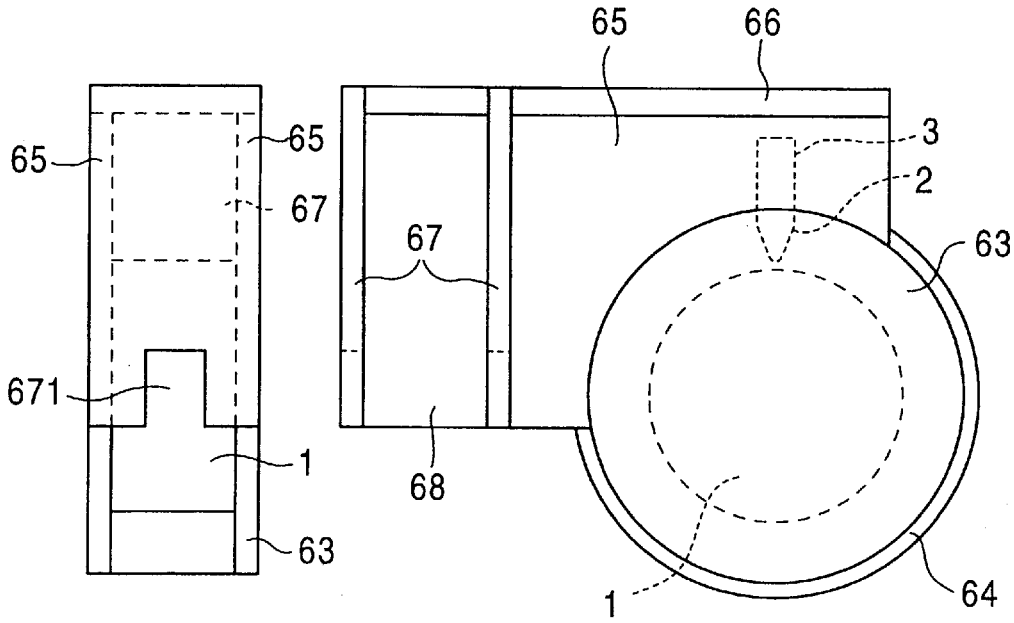
FIG. 4 is a view showing an example of the disposition of an atmosphere staying portion and atmosphere shutoff plates.
Figure 5:
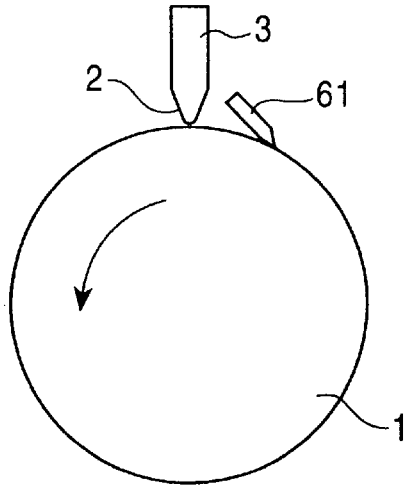
FIG. 5 is a view showing the disposition of a roll surface atmosphere shutoff plate.

The roll outside periphery atmosphere shutoff plate 64 is disposed to surround the cooling roll 1 around the outside periphery thereof while spaced apart from the outside periphery around the outside peripheral edge of the roll side atmosphere shutoff plates 63 (see FIG. 2 to FIG. 4). More specifically, the roll outside periphery atmosphere shutoff plate 64 extends around the outside periphery of the cooling roll 1 from the vicinity of the melt nozzle 2 toward the back of the rotational direction of the cooling roll 1, that is, in a direction opposite to the direction in which the ribbon is drawn out, as shown in FIG. 3.

The cooling roll 1 is disposed in a space which is partitioned by the roll outside periphery atmosphere shutoff plate 64 and the pair of roll side atmosphere shutoff plates 63. The roll surface atmosphere shutoff plate 61 can more enhance the atmosphere shutoff effect achieved by the roll surface atmosphere shutoff plate 61.

The roll forward atmosphere shutoff plates 65 extend from both the sides of cooling roll 1 toward the front of the rotating direction thereof, that is, from both the sides of the cooling roll 1 in the direction in which the ribbon is drawn out so as to clamp the drawn out ribbon.

The roll forward atmosphere shutoff plates 65 are disposed to shut off the flow of the atmosphere from the front of both the sides of the cooling roll 1 and extend from the roll side atmosphere shutoff plates 63 in a direction forward of the cooling roll 1 (see FIG. 2. and FIG. 4).

The roll side atmosphere shutoff plates 63 may be formed integrally with the roll forward atmosphere shutoff plates 65.

The shutoff plate 66 for the atmosphere above the roll front surface is disposed to extend from the vicinity of the melt nozzle toward the front of the rotational direction of the cooling roll 1, that is, in the direction in which the ribbon is drawn out from the cooling roll 1.

The shutoff plate 66 for the atmosphere above the roll front surface is disposed to shut off the flow of the atmosphere from above the cooling roll 1 and placed on and fixed to the upper edge of the roll forward atmosphere shutoff plates 65 which are disposed on both the sides of the cooling roll 1 (see FIG. 2 and FIG. 4).

The shutoff plates 67 for the atmosphere forward of the roll are disposed in the rotating direction of the cooling roll 1, that is, in the direction in which the ribbon is drawn out so that the drawn-out ribbon collides with the plates 67.

The shutoff plates 67 for the atmosphere forward of the roll are disposed to shut off the flow of the atmosphere from a front which confronts the cooling surface of the cooling roll 1 at two positions, that is, at the front end and approximate center of the roll forward atmosphere shutoff plates 65 (see FIG. 2 and FIG. 4). Ribbon passing ports 671 are formed to the lower ends of the shutoff plates 67 for the atmosphere forward of the roll and the ribbon passes therethrough when it is manufactured.

The shutoff plates 67 for the atmosphere forward of the roll are disposed at the two positions in the embodiment and the space therebetween forms the atmosphere staying portion 68.

The above respective atmosphere shutoff plates can be individually used as well as a plurality of them may be used. When all the atmosphere shutoff plates 61–67 are disposed, they approximately surround the cooling roll 1 so that the oxygen concentration reducing effect in the puddle portion 200 can be most enhanced by the gas flows from the first to fourth first gas flow nozzles 51–54. When the above respective atmosphere shutoff plates 61–67 are used individually, the roll surface atmosphere shutoff plate 61 and the roll side atmosphere shutoff plates 63 achieve the greatest oxygen quantity reducing effect.

Figure 7:
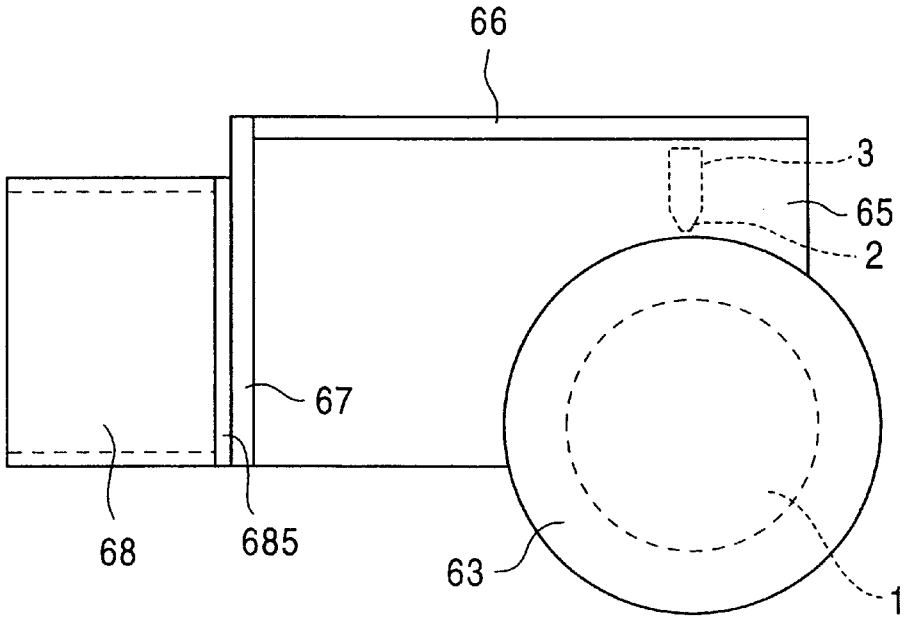
FIG. 7 is a view showing another example of the disposition of the atmosphere staying portion and the atmosphere shutoff plates.
Figure 8:
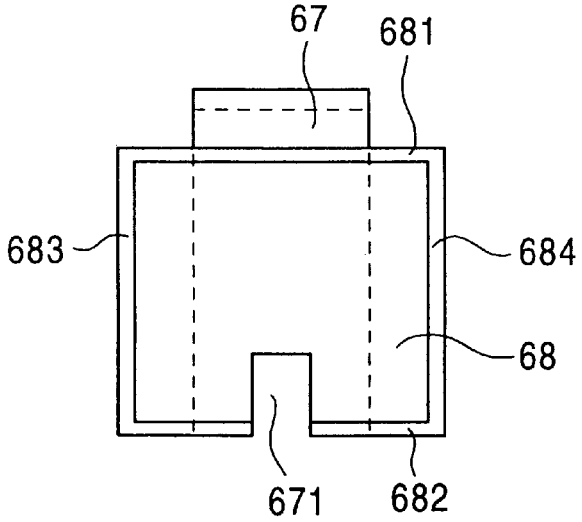
FIG. 8 is a view showing another example of the disposition of the atmosphere staying portion and the atmosphere shutoff plates.

Although the atmosphere staying portion 68 is formed in the space surrounded by the atmosphere shutoff plates 65, 66 and 67 in the above embodiment, it may be formed externally of the space surrounded by the atmosphere shutoff plates as shown in FIG. 7 and FIG. 8. That is, in FIG. 7 and FIG. 8 which show the side elevational view and the front elevational view of the apparatus (FIG. 8 omits the cooling roll 1 and the roll side atmosphere shutoff plates 63), the atmosphere staying portion 68 is formed of a rear wall 685 which is wider than the shutoff plates 67 for the atmosphere forward of the roll, upper/lower walls 681, 682 and left/right walls 683, 864. Although one end of the atmosphere staying portion 68 is closed in the embodiment, it may be closed.

Figure 9:
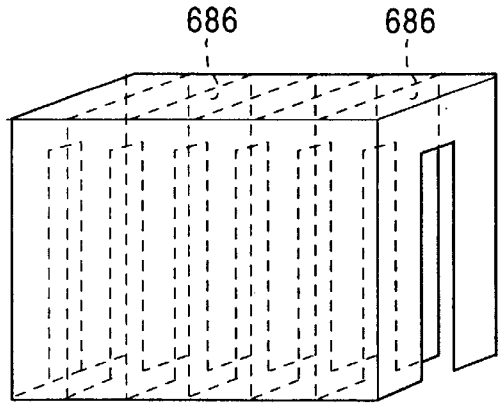
FIG. 9 is a view showing an example in which partitions are disposed to the atmosphere staying portion.
Figure 10:
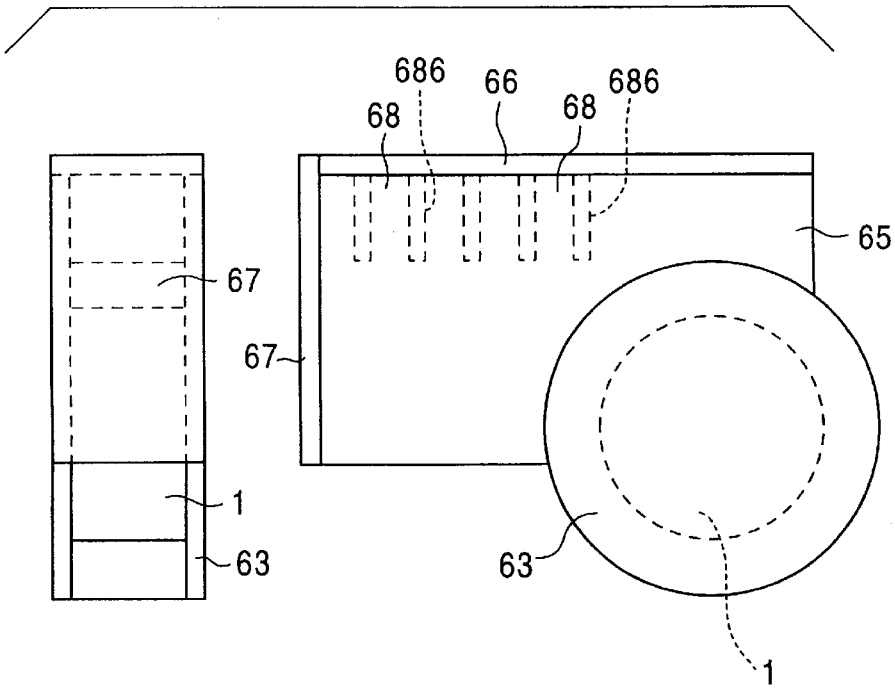
FIG. 10 is a view showing an example in which the atmosphere staying portion is formed by disposing partitions to the portion which is surrounded by the atmosphere shutoff plates.
Figure 11A:
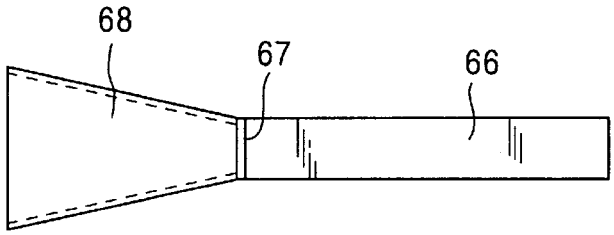
FIG. 11 is a view showing a form of the atmosphere staying portion.
Figure 11B:
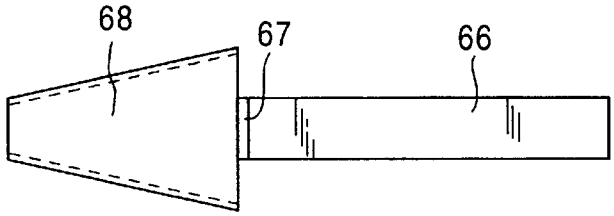
Figure 11C:
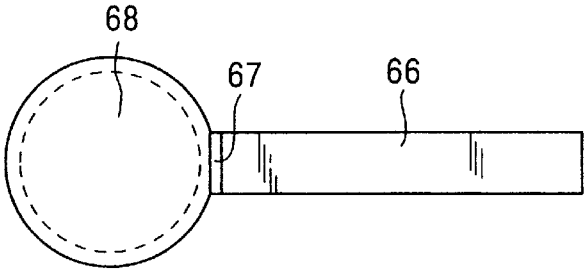
Figure 11D:
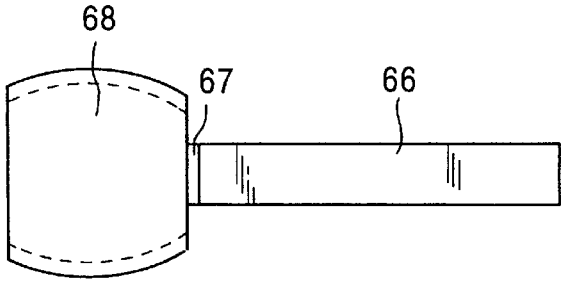

As shown in FIG. 9, the atmosphere staying portion 68 of the form shown in FIG. 7 and FIG. 8 may be provided with a plurality of partitions 686. The provision of the plurality of partitions 686 more enhances an atmosphere staying effect. Further, the atmosphere staying portion 68 can be formed by the plurality of partitions 686 disposed in the space surrounded by the atmosphere shutoff plates 65, 66, 67 as shown in FIG. 10.

Figure 12A:
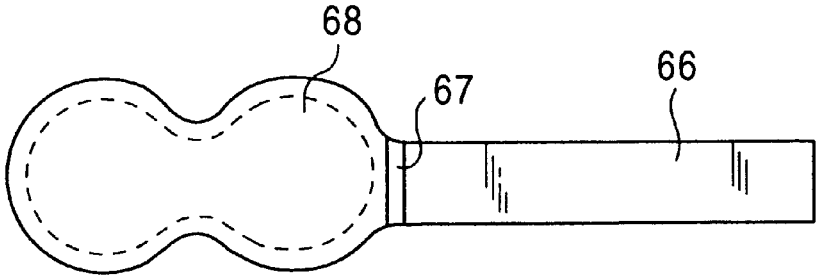
FIG. 12 is a view showing another form of the atmosphere staying portion.
Figure 12B:
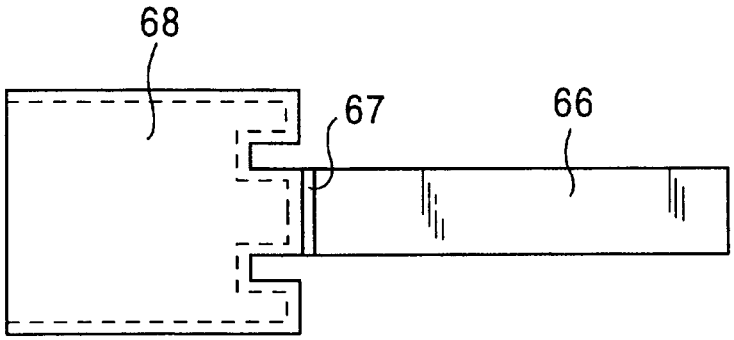

Although the atmosphere staying portion 68 shown in FIG. 7 and FIG. 8 has a certain width, the atmosphere staying portion of the present invention is not limited thereto. As shown in FIG. 11 and FIG. 12 which are pictorial plan views showing various forms of the atmosphere staying portion, the atmosphere staying portion can be embodied in a form having a width which gradually increases from the shutoff plates 67 for the atmosphere forward of the roll in the roll rotating direction (FIG. 11A), in a form having a width which gradually decreases contrary to the above (FIG. 11B), in a form having a width which increases once and then decreases from the midpoint thereof (FIG. 11C, FIG. 11D and FIG. 12A), and in a form having irregular portions in a lengthwise direction (FIG. 12B).

Figure 13:
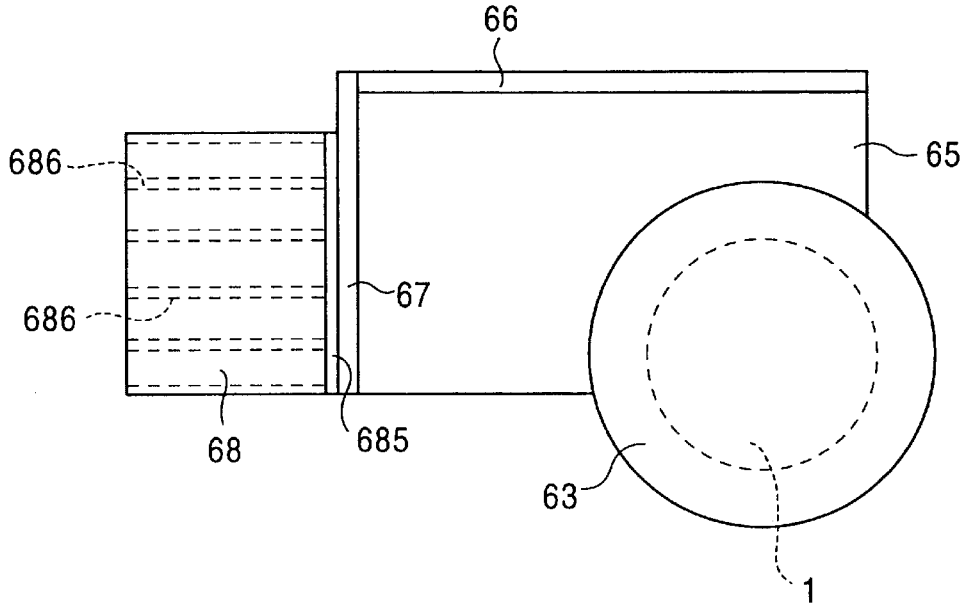
FIG. 13 is a view showing another example of the disposition of the partitions.
Figure 14:
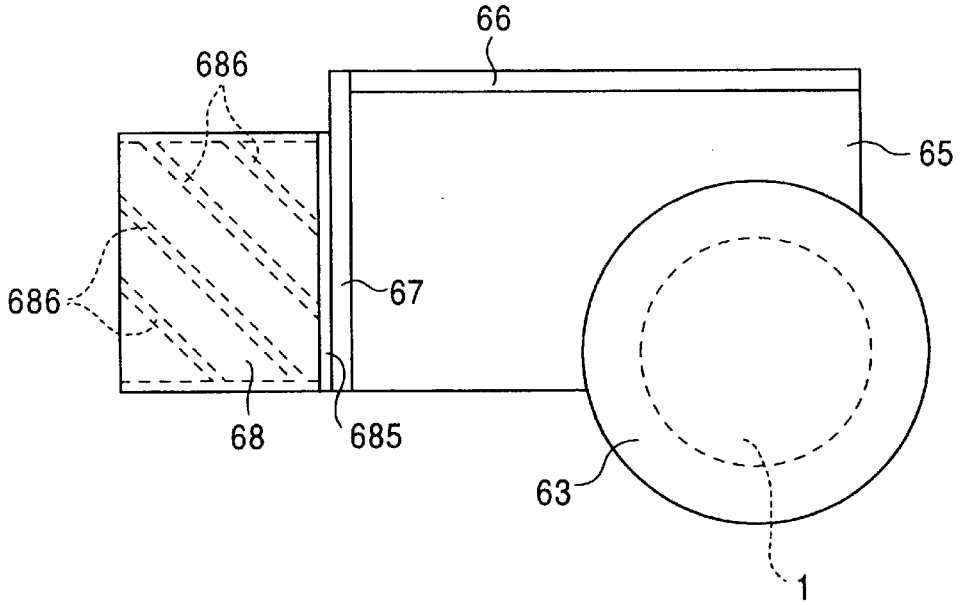
FIG. 14 is a view showing still another example of the disposition of the partitions.

The partitions 686 may be disposed in a horizontal direction as shown in FIG. 13 or obliquely as shown in FIG. 14, in addition to a vertical direction as shown in FIG. 9.

Figure 15A:
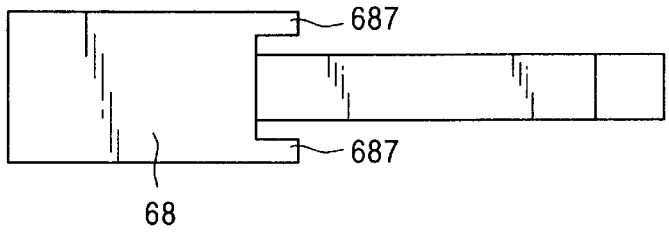
FIG. 15 is a view showing a form of the outside peripheral shape of the atmosphere staying portion.
Figure 15B:
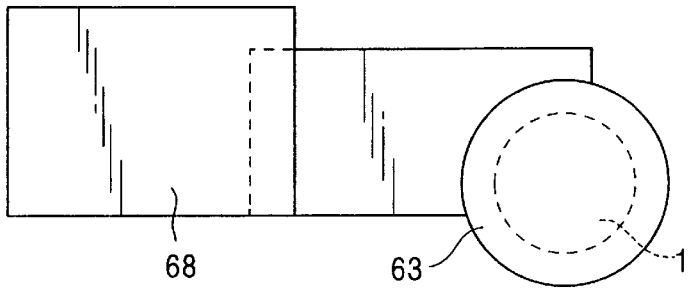
Figure 16A:
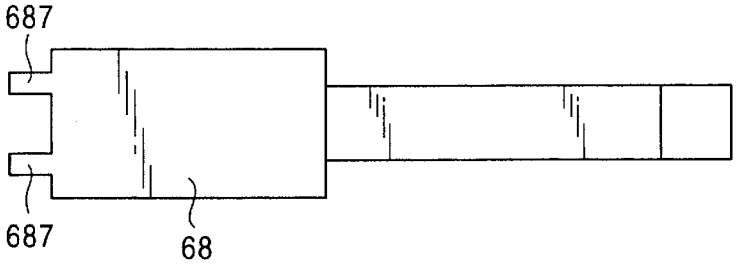
FIG. 16 is a view showing another form of the outside peripheral shape of the atmosphere staying portion.
Figure 16B:
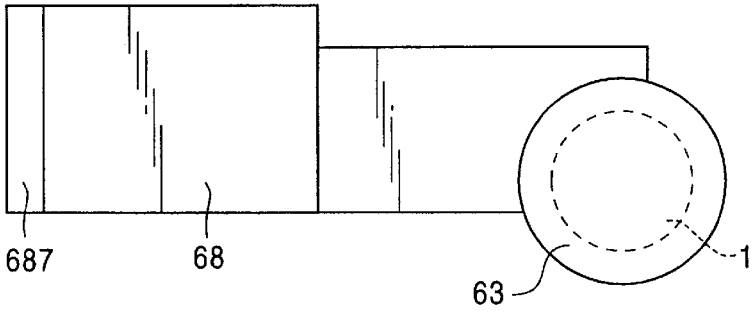

The outside peripheral shape of the atmosphere staying portion 68 may be embodied in a form having projections 687 which are disposed to the rear end thereof and extend backward as shown in FIG. 15A and FIG. 15B, in a form having the projections 687 which are disposed to the front end thereof and extend forward as shown in FIG. 16A and FIG. 16B, and in a form having the projections 687 which are disposed to the front and rear ends thereof and extend in side directions as shown in FIG. 17A and FIG. 17B.

Figure 21:
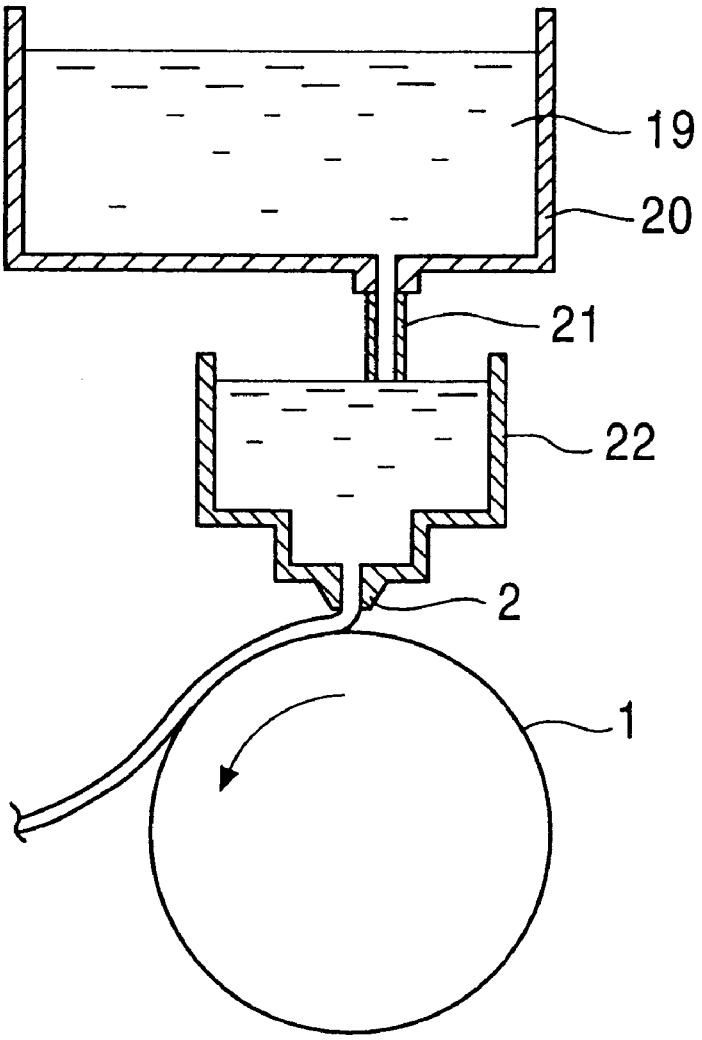
FIG. 21 is a view showing a form of a metal ribbon apparatus suitable to continuous production.

The ribbon manufacturing apparatus shown in FIG. 1 uses the crucible 3 having a small capacity, However, when a large quantity of a metal ribbon is continuously manufactured, the gas flows, atmosphere shutoff means and atmosphere staying portion of the present invention can be applied to a metal ribbon manufacturing apparatus comprising basic components shown in FIG. 21. That is, the metal ribbon manufacturing apparatus shown in FIG. 21 is arranged such that the a melt 19 is held in a melting furnace 20 and supplied into a tundish 22 from an outflow port formed to the bottom of the melting furnace 20 through an outflow pipe 21. The melt nozzle 2 is disposed to the bottom of the tundish 22 and the melt 19 is jetted from the melt nozzle 2 onto the surface of the cooling roll 1 which rotates at a high speed and solidified so that a ribbon is formed. According to the apparatus, when the quantity of the melt in the tundish 22 is reduced, it can be successively replenished from the melting furnace 20. Therefore, the apparatus is suitable to continuous production.

The following materials can be effectively applied to the present invention.

$Fe_bB_xM_y$

M is one kind or two or more kinds of elements (which always include any of Zr, Hf, Nd) selected from Ti, Zr, Hf, V, Nb, Ta, Mo, W, b is 75 at % or more to 93 at % or less, x is 0.5 at % or more to 18 at % or less and y is 4 at % or more to 9 at % or less.

$(Fe_{1-a}Z_a)_bB_xM_y$

Z is one kind or two kinds of Ni and Co, M is one kind or two or more kinds of elements selected from Ti, Zr, Hf, V, Nb, Ta, Mo, W (which preferably include any of Zr, Hf, Nb at all times), a is 0.2 or less, b is 75 at % or more to 93 at % or less, x is 0.5 at % or more to 18 at % or less and y is 4 at % or more to 9 at % or less.

$Fe_bB_xM_yX_z$

M is one kind or two or more kinds of elements selected from Ti, Zr, Hf, V, Nb, Ta, Mo, W (which preferably include any of Zr, Hf, Nb at all times), X is one kind or two or more kinds of elements selected from Cu, Ag, Cr, Ru, Rh, Ir, b is 75 at % or more to 93 at % or less, x is 0.5 at % or more to 18 at % or less, y is 4 at % or more to 9 at % or less and z is 5 at % or less.

$(Fe_{1-a}Z_a)_bB_xM_yX_z$

Z is one kind or two kinds of Ni and Co, M is one kind or two or more kinds of elements selected from Ti, Zr, Hf, V, Nb, Ta, Mo, W (which preferably include any of Zr, Hf, Nb at all times), X is one kind or two or more kinds of elements selected from Cu, Ag, Cr, Ru, Rh, Ir, a is 0.2 or less, b is 75 at % or more to 93 at % or less, x is 0.5 at % or more to 18 at % or less, y is 4 at % or more to 9 at % or less and z is 5 at % or less.

$Fe_bB_xM_yX_z$

M is one kind or two or more kinds of elements selected from Ti, Zr, Hf, V, Nb, Ta, Mo, W (which preferably include any of Zr, Hf, Nb at all times), X' is one kind or two or more kinds of elements selected from Si, Al, Ge, Ga, b is 75 at % or more to 93 at % or less, x is 0.5 at % or more to 18 at % or less, y is 4 at % or more to 9 at % or less and t is 4 at % or less.

$Fe_{1-a}Z_a)_bB_xM_yX'_t$

Z is one kind or two kinds of Ni and Co, M is one kind or two or more kinds of elements selected from Ti, Zr, Hf, V, Nb, Ta, Mo, W (which preferably include any of Zr, Hf, Nb at all times), X' is one kind or two or more kinds of elements selected from Si, Al, Ge, Ga, a is 0.2 or less, b is 75 at % or more to 93 at % or less, X is 0.5 at % or more to 18 at % or less, y is 4 at % or more to 9 at % or less and t is 4 at % or less.

$Fe_bB_xM_yX'_t$

M is one kind or two or more kinds of elements selected from Ti, Zr, Hf, V, Nb, Ta, Mo, W (which preferably include any of Zr, Hf, Nb at all times), X is one kind or two or more kinds of elements selected from Cu, Ag, Cr, Ru, Rh, Ir, X' is one kind or two or more kinds of elements selected from Si, Al, Ge, Ga, b is 75 at % or more to 93 at % or less, x is 0.5 at % or more to 18 at % or less, y is 4 at % or more to 9 at % or less, z is 5 at % or less and t is 4 at % or less.

$(Fe_{1-a})_bB_xM_yX_zX'_t$

Z is one kind or two kinds of Ni and Co, M is one kind or two or more kinds of elements selected from Ti, Zr, Hf, V, Nb, Ta, Mo, W (which preferably include any of Zr, Hf, Nb at all times), X is one kind or two or more kinds of elements selected from Cu, Ag, Cr, Ru, Rh, Ir, X' is one kind or two or more kinds of elements selected from Si, Al, Ge, Ga, a is 0.2 or less, b is 75 at % or more to 93 at % or less, x is 0.5 at % or more to 18 at % or less, y is 4 at % or more to 9 at % or less, z is 5 at % or less and t is 4 at % or less.

When amorphous alloy ribbons having the above compositions are obtained by the present invention and subjected to heat treatment in which they are heated to a temperature higher than a crystallizing temperature (for example, 500–600° C.) and then gradually cooled, soft magnetic alloy ribbons which have a fine crystal structure composed of crystals of 100–200 angstroms can be obtained.

EXAMPLES

A result of investigation of the variations of an inert gas flow time and an oxygen concentration executed by means of the metal ribbon manufacturing apparatus mentioned above will be described. In the following examples, the cooling roll 1 had a diameter of 300 mm and the melt nozzle 2 was located at a position 4 mm forward of the apex of the cooling roll 1. Further, an argon gas was used as the inert gas.

Example 1

Oxygen concentrations were measured as to a case that gas flow nozzles and atmosphere shutoff plates were constructed under the following conditions and an atmosphere staying portion was arranged as shown in FIG. 7 and FIG. 8 (apparatus No. 1) and a case that partitions 686 were additionally provided as shown in FIG. 9 (apparatus No. 2). The argon gas was used as the flow gas. The cooling roll 1 was rotated at 100 rpm after 15 minutes passed from the start of the gas flow and further rotated for 3 minutes after 2 minutes passed from the start thereof with a number of revolution increased to 2000 rpm. The oxygen concentration was measured using LC-700H made by Toray Co. at a position 0.3 mm apart from the surface of the cooling roll 1 on the front side of the melt nozzle 2. The oxygen concentration was measured without jetting a melt. In addition, an oxygen concentration was also measured as to a case that no atmosphere staying portion was provided (apparatus No. 3) likewise for comparison.

A quantity of gas flow was measured by means of a panel-mounted flow meter PF-7 made by Yutaka Co.

Conditions for gas flow nozzles first gas flow nozzle (flow rate: 200 l/min, flow speed: 19 m/sec);

second gas flow nozzle (flow rate: 200 l/min, flow speed: 4.8 m/sec); and third gas flow nozzle (flow rate: 200 l/min, flow speed: 19 m/sec)

Conditions for atmosphere shutoff plates roll surface atmosphere shutoff plate;

roll side atmosphere shutoff plates;

roll forward atmosphere shutoff plates;

roll backward atmosphere shutoff plate;

shutoff plate for atmosphere above roll front surface; and shutoff plate for atmosphere forward of roll Oxygen concentrations at the start of rotation of the cooling roll, when 2 minutes passed after the cooling roll rotated and when 5 minutes passed after the cooling roll rotated will be shown below. It has been confirmed that the provision of the atmosphere staying portion 68 can suppress an increase of the oxygen concentration when the cooling roll is rotated at a high speed and that the provision of the partitions further enhances the effect.

| Apparatus No. | Start of rotation | 2 minute passed | 5 minutes passed |
|---|---|---|---|
| 1 | 0.004% | 0.009% | 1.25% |
| 2 | 0.004% | 0.009% | 1.08% |
| 3 | 0.005% | 0.008% | 3.41% |

Three sets of alloy ribbons having a composition of $Fe_{84}Nb_{3.5}Zr_{3.5}B_8Cu_1$ (at %) were manufactured using No. 2. apparatus.

thickness: 30.5 pm, width: 15.6 mm, and overall length: 44 mm

When no atmosphere staying portion was provided, any ribbon could not be obtained due to the effect of oxidation.

The resultant ribbons (ribbon Nos. 1–3) were subjected to heat treatment (heated up to 650° C. at a rate of 40° C./min and then cooled) and permeability ($\mu'$), saturation magnetic flux density ($B_{10}$) and coercive force (Hc) were measured. A result of measurement is as shown below. There is also shown the characteristics of a ribbon (ribbon No. 4) having the same composition which was manufactured by the conventional method in which a ribbon manufacturing apparatus is disposed in a chamber having an inert gas atmosphere. It has been confirmed that the ribbons according to the present invention can provide magnetic characteristics which are the same as those of the ribbon manufactured by the conventional method.

| | $\mu'$ ($\times 10^3$) | | $B_{10}$ | Hc |
|---|---|---|---|---|
| Ribbon No. | 1 kHz | 10 kHz | (T) | (Oe) |
| 1 | 81.5 | 42.5 | 1.48 | 0.021 |
| 2 | 76.0 | 51.0 | 1.50 | 0.018 |
| 3 | 96.2 | 52.1 | 1.49 | 0.019 |
| 4 | 85.0 | 47.8 | 1.50 | 0.020 |

Example 2

An oxygen concentration reducing effect when two sheets of the roll surface atmosphere shutoff plate 61 were disposed was confirmed.

An investigation was carried out as to a case that the apparatus No. 1 in the example 1 was provided with one sheet of the roll surface atmosphere shutoff plate 51 and as to a case that the apparatus No. 1 was provided with two sheets of it.

Figure 22:
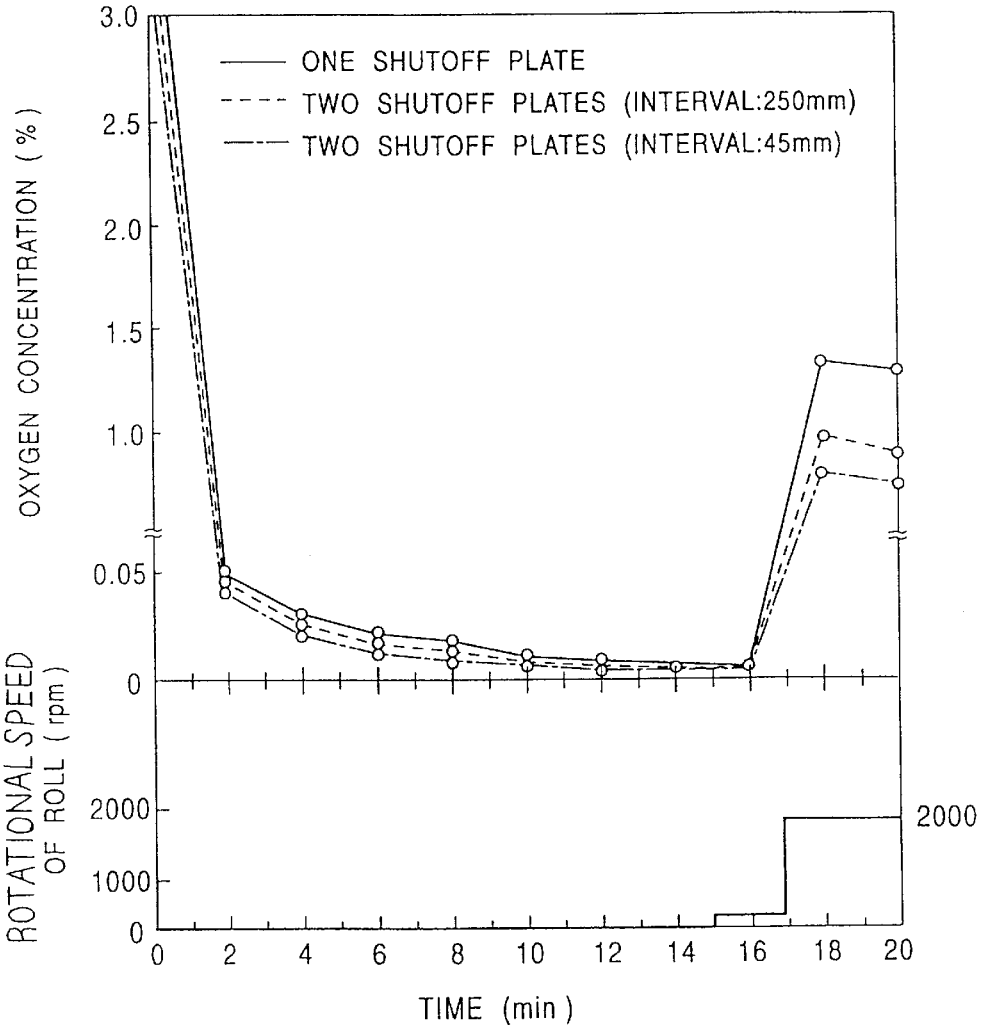
FIG. 22 is a graph showing the relationship between the rotational speed of a roll and an axygen concentration when two sheets of the roll surface atmosphere shutoff plate are disposed.

The oxygen concentration reducing effect was confirmed as to two types, that is, a case that an interval between the two roll surface atmosphere shutoff plates 61 was set to 45 mm and a case that an interval therebetween was set to 250 mm as well as the effect was also confirmed as to a case that one sheet of the roll surface atmosphere shutoff plate 61 was disposed for comparison. FIG. 22 shows a result of investigation. FIG. 22 also shows a number of revolution of the cooling roll.

As shown in FIG. 22, it has been found that when the cooling roll is rotated at a high speed (2000 rpm), the case of the two roll surface atmosphere shutoff plates can suppress the oxygen concentration to a lower level than the case of the one roll surface atmosphere shutoff plate and that when the two shutoff plates are provided, the smaller interval therebetween can suppress the oxygen concentration to a lower level at the time the cooling roll is rotated at the high speed (2000 rpm).

Example 3

There was confirmed an oxygen concentration reducing effect when the roll outside periphery atmosphere shutoff plate 64 was provided.

Figure 23:
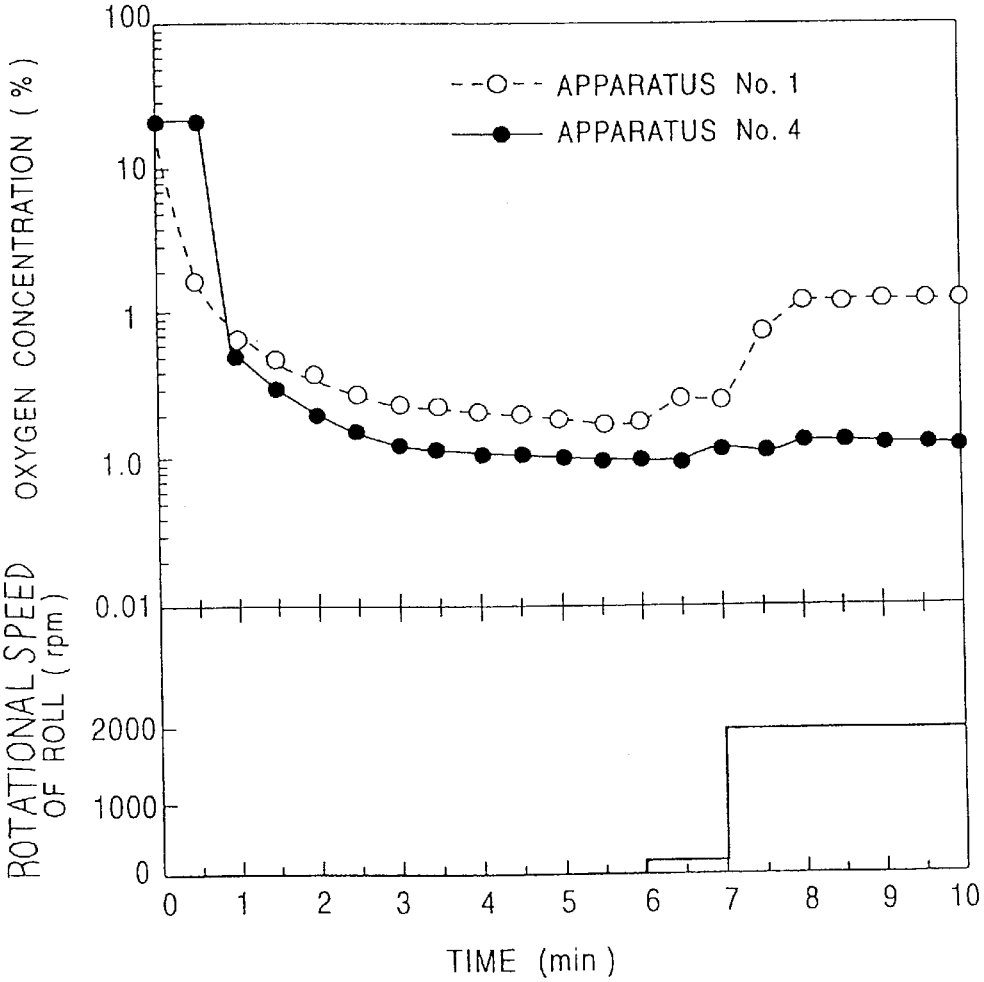
FIG. 23 is a graph showing the relationship between the rotational speed of a roll and an oxygen concentration when the roll outside periphery shutoff plate is (disposed.
Figure 24:
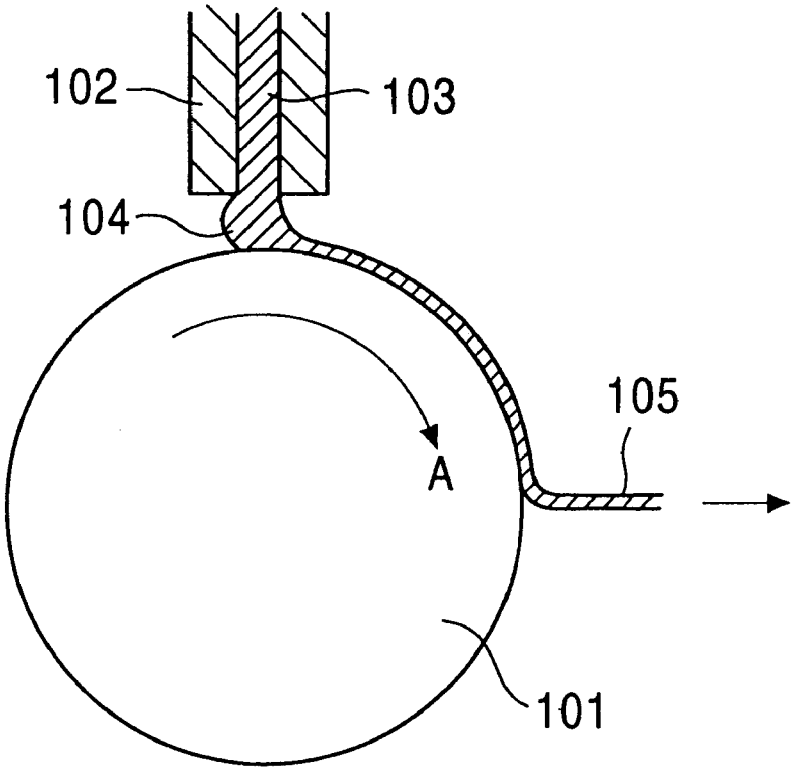
FIG. 24 is a view showing a ribbon manufactured by a single roll method.

There were used the apparatus No. 1 in the example 1 and an apparatus No. 4 which was arranged by mounting the roll outside periphery atmosphere shutoff plate 64 as shown in FIG. 2 to FIG. 4 to the apparatus No. 1. FIG. 23 shows a result of confirmation. FIG. 23 also shows the rotational speed of the cooling roll.

As shown in FIG. 23, when the cooling roll rotates at the high speed (2000 rpm) in the apparatus No. 1, the atmosphere is rolled in by the cooling roll in rotation to thereby increase the oxygen concentration in a puddle portion.

On the other hand, the oxygen concentration does not change before and after the cooling roll starts to rotate at the high speed (2000 rpm) and even if the cooling roll is further rotated, the oxygen concentration is maintained at a low level. Therefore, when a metal ribbon is manufactured by the apparatus No. 4, the ribbon can be manufactured in a low oxygen concentration state at all times.

As described above, it has been found that the roll outside periphery atmosphere shutoff plate 64 can suppress the oxygen concentration in the puddle portion to a low level by preventing the atmosphere from being rolled in by the rotation of the cooling roll.

What is claimed is:

1. A metal ribbon manufacturing apparatus comprising:

a cooling roll having a cooling surface for cooling a melt;

a melt nozzle confronting the cooling surface with a prescribed gap maintained between it and the cooling roll;

gas flow supply means for supplying an inert gas to the periphery of the melt nozzle;

roll outside periphery atmosphere shutoff means for covering at least a portion of the outside periphery of the cooling roll and preventing the atmosphere from being rolled in by the rotation of the cooling roll; and an atmosphere staying portion disposed on the front side in the rotating direction of the cooling roll of the roll outside periphery atmosphere shutoff means, wherein the atmosphere staying portion is disposed internally of the roll outside periphery atmosphere shutoff means.

2. A metal ribbon manufacturing apparatus according to claim 1, wherein said atmosphere staying portion is separated by a plurality of partitions.

3. A metal ribbon manufacturing apparatus according to claim 1, wherein the open area of said atmosphere staying portion changes toward the rotating direction of said cooling roll.

4. A metal ribbon manufacturing apparatus, comprising:

a cooling roll having a cooling surface for cooling a melt;

a melt nozzle confronting the cooling surface with a prescribed gap maintained between it and the cooling roll;

gas flow supply means for supplying an inert gas to the periphery of the melt nozzle;

roll outside periphery atmosphere shutoff means for covering at least a portion of the outside periphery of the cooling roll and preventing the atmosphere from being rolled in by the rotation of the cooling roll; and an atmosphere staying portion disposed on the front side in the rotating direction of the cooling roll of the roll outside periphery atmosphere shutoff means, wherein the atmosphere staying portion has an open area which is larger than that of the roll outside periphery atmosphere shutoff means; and wherein the atmosphere staying portion is disposed externally of the roll outside periphery atmosphere shutoff means.

5. A metal ribbon manufacturing apparatus according to claim 4, wherein said atmosphere staying portion is separated by a plurality of partitions.

6. A metal ribbon manufacturing apparatus according to claim 4, wherein the open area of said atmosphere staying portion changes toward the rotating direction of said cooling roll.

7. A metal ribbon manufacturing apparatus according to claim 4, wherein said atmosphere staying portion is separated by a plurality of partitions.

8. A metal ribbon manufacturing apparatus according to claim 4, wherein the open area of said atmosphere staying portion changes toward the rotating direction of said cooling roll.

9. A metal ribbon manufacturing apparatus comprising:

a cooling roll having a cooling surface for cooling a melt;

a melt nozzle confronting the cooling surface with a prescribed gap maintained between it and the cooling roll;

gas flow supply means for supplying an inert gas to the periphery of the melt nozzle;

roll outside periphery atmosphere shutoff means for covering at least a portion of the outside periphery of the cooling roll and preventing the atmosphere from being rolled in by the rotation of the cooling roll; and an atmosphere staying portion disposed on the front side in the rotating direction of the cooling roll of the roll outside periphery atmosphere shutoff means, wherein the atmosphere staying portion is separated by a plurality of partitions.

10. A metal ribbon manufacturing apparatus according to claim 9, wherein the open area of said atmosphere staying portion changes toward the rotating direction of said cooling roll.

11. A metal ribbon manufacturing apparatus comprising:

a cooling roll having a cooling surface for cooling a melt;

a melt nozzle confronting the cooling surface with a prescribed gap maintained between it and the cooling roll;

gas flow supply means for supplying an inert gas to the periphery of the melt nozzle;

roll outside periphery atmosphere shutoff means for covering at least a portion of the outside periphery of the cooling roll and preventing the atmosphere from being rolled in by the rotation of the cooling roll; and an atmosphere staying portion disposed on the front side in the rotating direction of the cooling roll of the roll outside periphery atmosphere shutoff means, wherein the open area of the atmosphere staying portion changes toward the rotating direction of the cooling roll.

12. A metal ribbon manufacturing apparatus according to claim 11, wherein the open area of said atmosphere staying portion increases toward the rotating direction of said cooling roll.

13. A metal ribbon manufacturing apparatus according to claim 11, wherein the open area of said atmosphere staying portion decreases toward the rotating direction of said cooling roll.

14. A metal ribbon manufacturing apparatus according to claim 11, wherein the sides of said atmosphere staying portion have a curved surface.

15. A metal ribbon manufacturing apparatus comprising:

a cooling roll having a cooling surface for cooling a melt;

a melt nozzle confronting the cooling surface with a prescribed gap maintained between it and the cooling roll;

gas flow supply means for supplying an inert gas to the periphery of the melt nozzle;

roll outside periphery atmosphere shutoff means for covering at least a portion of the outside periphery of the cooling roll and preventing the atmosphere from being rolled in by the rotation of the cooling roll; and an atmosphere staying portion disposed on the front side in the rotating direction of the cooling roll of the roll outside periphery atmosphere shutoff means, wherein the roll outside periphery atmosphere shutoff means comprises shutoff plates disposed on the front side in the rotating direction of the cooling roll, on the sides of the cooling roll and on the back side in the rotating direction of the cooling roll.

16. A metal ribbon manufacturing apparatus according to claim 15, wherein said roll outside periphery atmosphere shutoff means comprises shutoff plates disposed on the front side in the rotating direction of said cooling roll, on the sides of said cooling roll and on the back side in the rotating direction of said cooling roll and a passing port through which a metal ribbon formed by being cooled by said cooling roll passes is formed to the shutoff plate disposed on the front side in the rotating direction of said cooling roll.

17. A metal ribbon manufacturing apparatus according to claim 15, wherein the gas supplied from said gas flow supply means has a flow speed of 2–80 m/sec and a flow rate of 200–900 l/min.

18. A metal ribbon manufacturing apparatus according to claim 16, wherein the gas supplied from said gas flow supply means has a flow speed of 2–80 m/sec and a flow rate of 200–900 l/min.

* * * * *